US007458109B1

(12) United States Patent
Kreisel

(10) Patent No.: US 7,458,109 B1
(45) Date of Patent: Dec. 2, 2008

(54) TOILET SKIRTING DEVICE

(76) Inventor: Ronald L. Kreisel, 208 W. Walnut St., El Dorado Springs, MO (US) 64744

( * ) Notice: Subject to any disclaimer, the term of this patent is extended or adjusted under 35 U.S.C. 154(b) by 295 days.

(21) Appl. No.: 11/415,502

(22) Filed: May 1, 2006

(51) Int. Cl.
*E03D 11/14* (2006.01)

(52) U.S. Cl. ..... 4/252.1; 4/251.1

(58) Field of Classification Search ..... 4/252.1, 4/251.1; 285/56–60
See application file for complete search history.

(56) References Cited

U.S. PATENT DOCUMENTS

| | | | | | |
|---|---|---|---|---|---|
| 1,333,368 | A * | 3/1920 | Auer | 4/252.5 |
| 1,533,444 | A * | 4/1925 | Mohr | 4/252.1 |
| 2,229,814 | A | 1/1941 | Kolajazak | |
| 2,479,837 | A * | 8/1949 | Hollaender | 285/60 |
| 4,165,545 | A * | 8/1979 | Stoltzfus | 4/251.1 |
| 4,285,075 | A | 8/1981 | Nelson | |
| 5,437,303 | A | 8/1995 | Johnson | |
| 5,452,739 | A | 9/1995 | Mustee et al. | |
| 5,608,922 | A * | 3/1997 | Lewis | 4/251.1 |
| 6,085,361 | A | 7/2000 | Whitaker | |
| 6,128,947 | A * | 10/2000 | Anderson, Sr. | 73/46 |
| 6,174,581 | B1 | 1/2001 | Barker | |
| 6,295,658 | B1 * | 10/2001 | Jenkins | 4/251.1 |
| D506,342 | S | 6/2005 | Amorin | |
| 7,069,603 | B2 * | 7/2006 | Flushing | 4/252.1 |

* cited by examiner

*Primary Examiner*—Charles E Phillips

(57) ABSTRACT

A toilet skirting device for inhibiting liquids leaking from a toilet from contacting a floor of a bathroom includes a plate being secured to a floor of a bathroom and having an opening extending therethrough being aligned with a waste pipe extending through the floor. The plate receives a toilet to inhibit seepage from a bottom end of the toilet from contacting the floor. A wax seal is positioned between the bottom end of the toilet and the plate. The wax seal forms a seal between the bottom end of the toilet and the plate to inhibit seepage of the liquid between the toilet and the plate.

5 Claims, 3 Drawing Sheets

TOILET SKIRTING DEVICE

BACKGROUND OF THE INVENTION

1. Field of the Invention

The present invention relates to toilet skirts and more particularly pertains to a new toilet skirt for inhibiting liquids leaking from a toilet contacting a floor of a bathroom.

2. Description of the Prior Art

The use of toilet skirts is known in the prior art. The prior art commonly teaches a skirt positioned around a toilet to inhibit contact between liquids from the toilet and a floor.

While these devices fulfill their respective, particular objectives and requirements, the need remains for a device that has certain improved features to position the device between a floor and a bottom end of a toilet to inhibit seepage from the bottom end of the toilet from contacting the floor. Additionally, the device has a lip for inhibit liquids from the toilet spreading further than the lip.

SUMMARY OF THE INVENTION

The present invention meets the needs presented above by generally comprising a plate being secured to a floor of a bathroom and having an opening extending therethrough to be aligned with a waste pipe extending through the floor. The plate receives a toilet to inhibit seepage from a bottom end of the toilet from contacting the floor. A wax seal is positioned between the bottom end of the toilet and the plate. The wax seal forms a seal between the bottom end of the toilet and the plate to inhibit seepage of the liquid between the toilet and the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
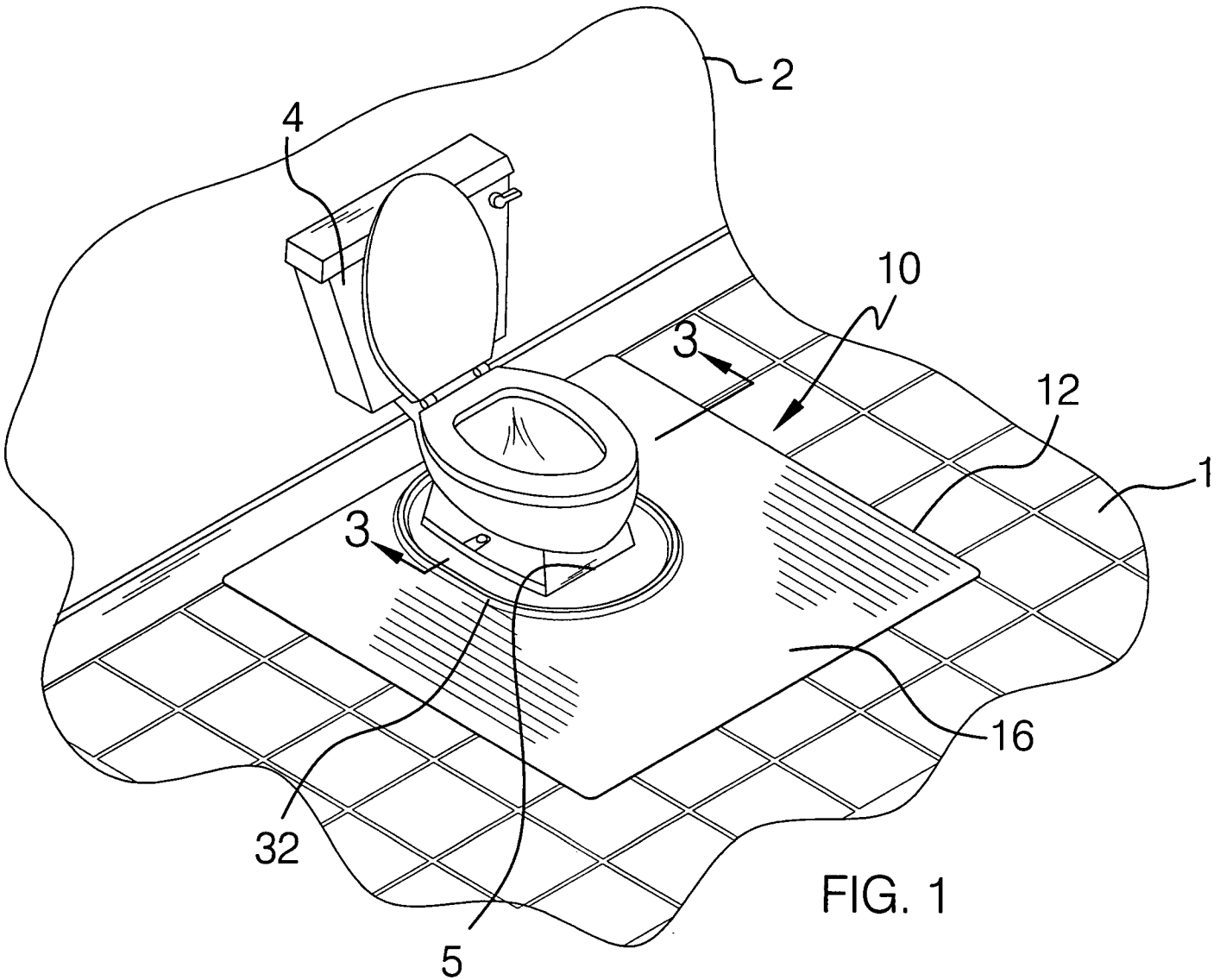
FIG. 1 is a perspective view of a toilet skirting device according to the present invention shown in place in a bathroom.
Figure 2:
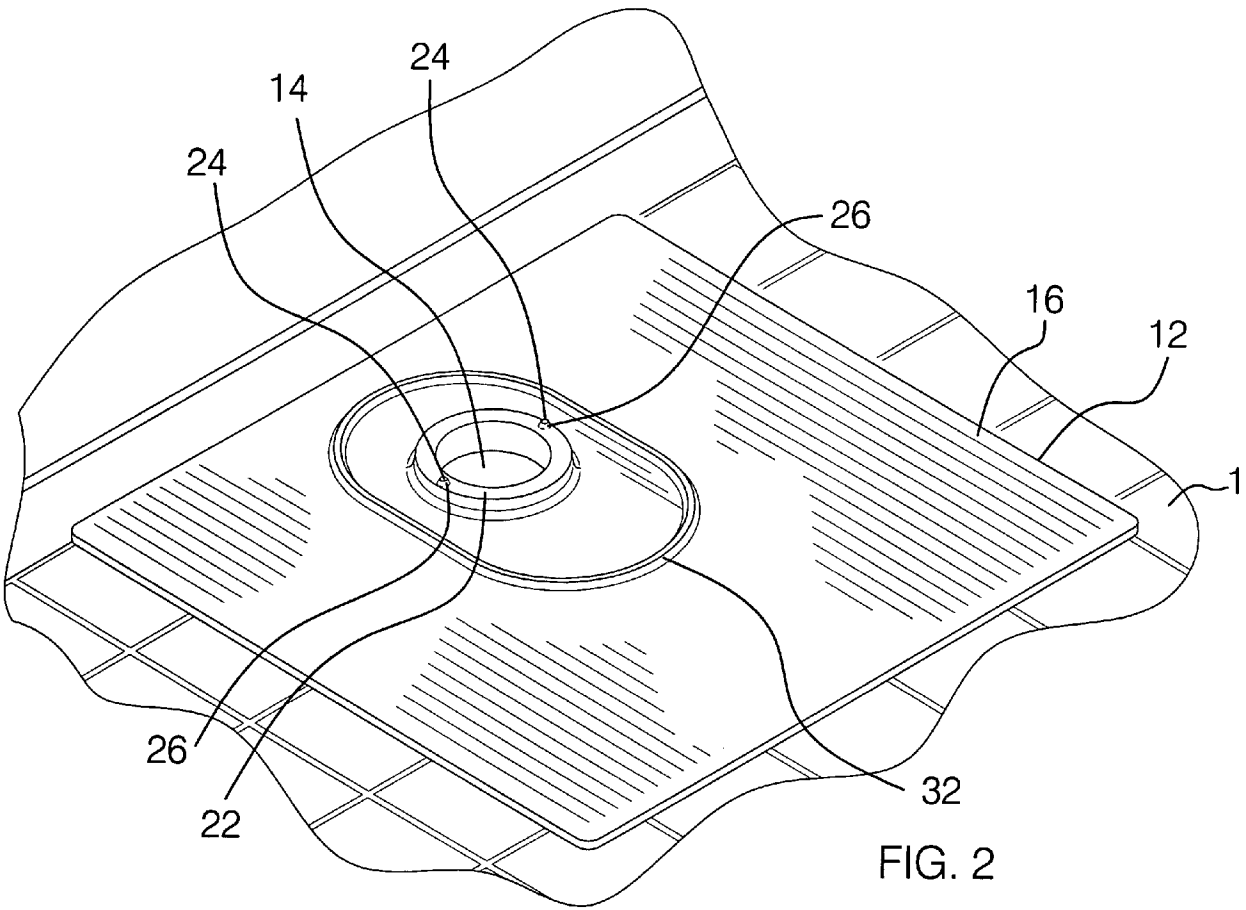
FIG. 2 is a perspective view of the plate of the present invention.
Figure 3:
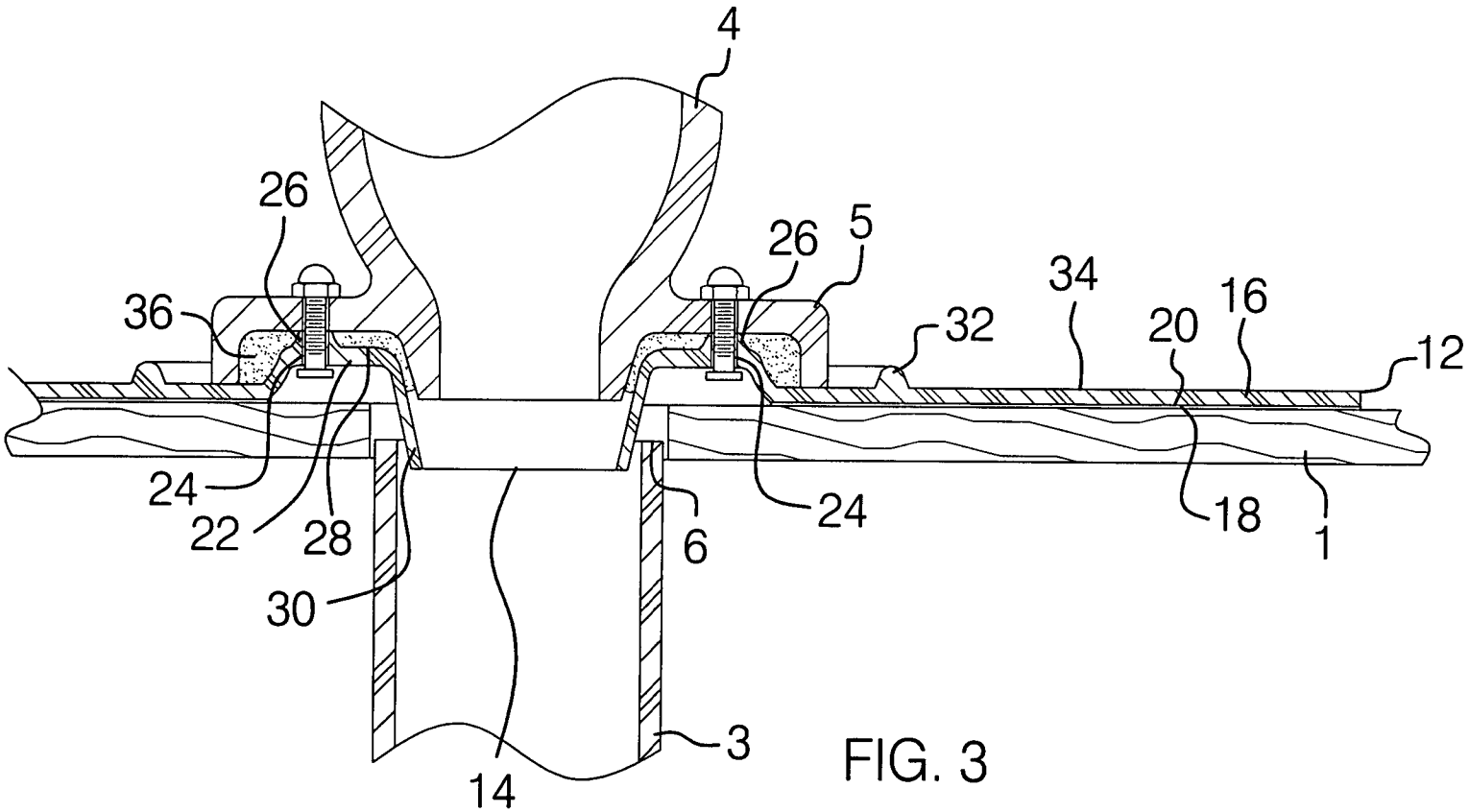
FIG. 3 is a cross-sectional view of the present invention taken along line 3-3 of FIG. 1.

With reference now to the drawings, and in particular to FIGS. 1 through 3 thereof, a new toilet skirt embodying the principles and concepts of the present invention and generally designated by the reference numeral 10 will be described.

As best illustrated in FIGS. 1 through 3, the toilet skirting device 10 generally comprises a plate 12 being secured to a floor 1 of a bathroom 2 and having an opening 14 extending therethrough aligned with a waste pipe 3 extending through the floor 1. The plate 12 receives a toilet 4 to inhibit seepage from a bottom end 5 of the toilet 4 from contacting the floor 1. The plate 12 includes a planar portion 16 positioned under the bottom end 5 of the toilet 4. The planar portion 16 extends outwardly from the toilet 4 and parallel to the floor 1. An adhesive 18 is coupled to a bottom surface 20 of the planar portion 16. The adhesive 18 adheres the plate 12 to the floor 1 to inhibit sliding of the plate 12 along the floor 1.

The plate 12 also includes a base portion 22 upwardly extending from the planar portion 16. The base portion 22 is annularly positioned around the waste pipe 3. The base portion 22 extends into the bottom end 5 of the toilet 4 when the toilet 4 is placed on the plate 12. The base portion 22 has a plurality of fastener apertures 24 extending therethrough. The fastener apertures 24 permit bolts to extend through the base portion 22 and through the toilet 4 to secure the toilet 4 to the base portion 22. Each of a plurality of raised portions 26 is coupled to an upper surface 28 of the base portion 22. Each of the raised portions 26 extends around one of the fastener apertures 24 and engages the toilet 4 to inhibit bending of the base portion 22 when the toilet 4 is secured to the base portion 22.

A funnel portion 30 is coupled to the raised portion and downwardly extends from the upper surface 28 of the base portion 22. The funnel portion 30 is inserted into an upper end 6 of the waste pipe 3. The funnel portion 30 is in fluid communication with the toilet 4 to guide liquid flushed from the toilet 4 into the waste pipe 3. A lip 32 upwardly extends from a top surface 34 of the planar portion 16. The lip 32 is positioned around the base portion 22 to position the bottom end 5 of the toilet 4 between the base portion 22 and the lip 32. The lip 32 contains liquid seeping from the bottom end 5 to inhibit the liquid from spreading further on the planar portion 16.

A wax seal 36 is positioned between the bottom end 5 of the toilet 4 and the plate 12. The wax seal 36 forms a seal between the bottom end 5 of the toilet 4 and the plate 12 to inhibit seepage of the liquid between the toilet 4 and the plate 12. The wax seal 36 is positioned between the base portion 22 and the bottom of the toilet 4.

In use, the plate 12 is positioned on the floor 1 of the bathroom 2 with the opening 14 of the plate 12 positioned around the waste pipe 3. The bolts are extended through the fastener apertures 24 before the adhesive 18 is used to secure the plate 12 to the floor 1. The was seal 36 is placed on the upper surface 28 of the base portion 22. The bottom end 5 of the toilet 4 is positioned over the base portion 22 with the bolts extending through the bottom end 5 of the toilet 4 to secure the toilet 4 to the plate 12 and compress the was seal 36. The funnel portion 30 extends into the waste pipe 3 and receives fluids flushed from the toilet 4 and guides the fluids into the waste pipe 3.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet skirting device for inhibiting seepage of liquid from a bottom end of a toilet, said device comprising:

a plate being secured to a floor of a bathroom and having an opening extending therethrough being aligned with a waste pipe extending through the floor said plate receiving the toilet to inhibit seepage from the bottom end of the toilet from contacting the floor, said plate including;

a planar portion being positioned under the bottom end of the toilet, said planar portion extending outwardly from the toilet and being parallel to the floor;

a base portion upwardly extending from said planar portion, said base portion being annularly positioned around the waste pipe, said base portion extending into the bottom end of the toilet when the toilet is placed on said plate, a wax seal being positioned between said base portion and the bottom of the toilet, said base portion having a plurality of fastener apertures extending therethrough, said fastener apertures permitting bolts to extend through said base portion and through the toilet to secure the toilet to said base portion;

a plurality of raised portions, each of said raised portions being coupled to an upper surface of said base portion, one of said raised portions extending around each one of said fastener apertures and engaging the toilet to inhibit bending of said base portion when the toilet is secured to said base portion; and a wax seal being positioned between said bottom end of the toilet and said plate, said wax seal forming a seal between the bottom end of the toilet and said plate to inhibit seepage of the liquid between the toilet and said plate.

2. The device according to claim 1, wherein said plate includes an adhesive being coupled to a bottom surface of said planar portion, said adhesive adhering said plate to the floor to inhibit sliding of said plate along the floor.

3. The device according to claim 1, wherein said plate includes a funnel portion being coupled to said raised portion and downwardly extending from an upper surface of said base portion, said funnel portion being inserted into an upper end of the waste pipe, said funnel portion being in fluid communication with the toilet to guide liquid flushed from the toilet into the waste pipe.

4. The device according to claim 1, wherein said plate includes a lip upwardly extending from a top surface of said planar portion, said lip being positioned around said base portion to position the bottom end of the toilet between said base portion and said lip, said lip containing liquid seeping from the bottom end to inhibit the liquid from spreading further on said planar portion.

5. A toilet skirting device for inhibiting seepage of liquid from a bottom end of a toilet, said device comprising:

a plate being secured to a floor of a bathroom and having an opening extending therethrough being aligned with a waste pipe extending through the floor, said plate receiving the toilet to inhibit seepage from the bottom end of the toilet from contacting the floor, said plate comprising:

a planar portion being positioned under the bottom end of the toilet, said planar portion extending outwardly from the toilet and parallel to the floor;

an adhesive being coupled to a bottom surface of said planar portion, said adhesive adhering said plate to the floor to inhibit sliding of said plate along the floor;

a base portion upwardly extending from said planar portion, said base portion being annularly positioned around the waste pipe, said base portion extending into the bottom end of the toilet when the toilet is placed on said plate, said base portion having a plurality of fastener apertures extending therethrough, said fastener apertures permitting bolts to extend through said base portion and through the toilet to secure the toilet to said base portion;

a plurality of raised portions, each of said raised portions being coupled to an upper surface of said base portion, one of said raised portions extending around each of said fastener apertures and engaging the toilet to inhibit bending of said base portion when the toilet is secured to said base portion;

a funnel portion being coupled to said raised portion and downwardly extending from said upper surface of said base portion, said funnel portion being inserted into an upper end of the waste pipe, said funnel portion being in fluid communication with the toilet to guide liquid flushed from the toilet into the waste pipe;

a lip upwardly extending from a top surface of said planar portion, said lip being positioned around said base portion to position the bottom end of the toilet between said base portion and said lip, said lip containing liquid seeping from the bottom end to inhibit the liquid from spreading further on said planar portion; and a wax seal being positioned between said bottom end of the toilet and said plate, said wax seal forming a seal between the bottom end of the toilet and said plate to inhibit seepage of the liquid between the toilet and said plate, said wax seal being positioned between said base portion and the bottom of the toilet.

* * * * *